US005437540A

United States Patent [19]

Blocker et al.

[11] Patent Number: 5,437,540

[45] Date of Patent: Aug. 1, 1995

[54] ILLUMINATED BLADE, CEILING FAN APPARATUS

[76] Inventors: Blane T. Blocker; Eva B. Blocker, both of 37-33 28th St., #17, Long Island City, N.Y. 11101

[21] Appl. No.: 127,183

[22] Filed: Sep. 27, 1993

[51] Int. Cl.[6] ..... F04D 29/00

[52] U.S. Cl. ..... 416/5; 362/96; 310/232

[58] Field of Search ..... 416/5; 362/96, 294, 362/405; 310/231, 232

[56] References Cited

U.S. PATENT DOCUMENTS

| | | | |
|---|---|---|---|
| 3,701,498 | 10/1972 | Ferrara | 416/5 |
| 5,028,206 | 7/1991 | Kendregan et al. | 416/5 |
| 5,072,341 | 12/1991 | Huang | 362/96 |
| 5,082,422 | 1/1992 | Wang | 416/5 |

*Primary Examiner*—Edward K. Look
*Assistant Examiner*—James A. Larson

[57] ABSTRACT

A new and improved illuminated blade, ceiling fan apparatus includes a circular planar electrical contact assembly which includes a first circular planar conductor and a second circular planar conductor spaced from the first planar conductor such that the first planar conductor and the second planar conductor are not in electrical contact with each other. A brush contact assembly includes brushes for providing sliding electrical contact with the first planar conductor and the second planar conductor when there is relative rotation between the circular planar electrical contact assembly and the brush contact assembly. Respective sources of illumination, e. g. neon lamps, supported by the fan blade assemblies are in circuit with the circular planar electrical contact assembly and the brush contact assembly, such that the sources of illumination are energized when the brush contact assembly is in electrical contact with the first circular planar conductor and the second circular planar conductor. The fan blade assemblies may include blade members which include hollow interiors and are made from transparent materials. The sources of illumination are housed within the hollow interiors of the transparent blade members. A partially opaque and partially transparent design is supported by a transparent blade member, such that, when a source of illumination is energized, the partially opaque and partially transparent design is provided with backlighting. Either the first circular planar conductor or the second circular planar conductor includes a discontinuous circular conductive path. The discontinuous conductive path provides intermittent illumination.

8 Claims, 4 Drawing Sheets

ILLUMINATED BLADE, CEILING FAN APPARATUS

BACKGROUND OF THE INVENTION

1. Field of the Invention

The present invention relates generally to ceiling fans, and, more particularly, to ceiling fans which include illuminated blades.

2. Description of the Prior Art

Ceiling fans which have illuminated fan blades are known in the art, and the following U.S. patents disclose such ceiling fans: U.S. Pat. Nos. 5,028,206 and 5,082,422.

More specifically, U.S. Pat. No. 5,028,206 discloses an illuminated ceiling fan in which sources of illumination, which may be neon tubes, are secured to the outer periphery of the rotating blades for rotation therewith. The sources of illumination define the shape of each blade when the source of illumination is energized. A problem associated with this device is that each neon tube is supported only at the edge of each fan blade. This edge support is potentially insecure. In this respect, it would be desirable if an illuminated ceiling fan device were provided which included support for neon tubes which were more secure than mere edge support.

Another problem associated with the edge support of the neon tubes on the fan blades is the disruption of the aerodynamic properties of the fan blades. The air scooping and air throwing properties of a fan blade are highly dependent upon the overall shape of the fan blade. When a neon light is added to the surface of the fan blade, the overall shape of the fan blade is changed, and the air scooping and air throwing properties of the fan blade are also changed. This is especially so when changes in the shape of the fan blade are made at the edges of the fan blade. In this respect, it would be desirable if an illuminated ceiling fan device were provided which did not change the contour of the fan blade at the edge of the fan blade.

U.S. Pat. No. 5,082,422 discloses an illuminated ceiling fan which employs a pair of stationary electrical contacts having curved surfaces which are located on the outside wall of a cylindrical support. The outside wall curved surfaces of the stationary electrical contacts are contacted with a pair of rotating brushes which rotate along with the rotating fan blades. A number of problems are associated with the use of electrical contacts that are curved surfaces on the outside wall of a cylindrical support. One problem is the fabrication of curved surface having a uniform radius of curvature throughout the curved contact. Attainment of such a contact having a uniform radius of curvature throughout is a difficult manufacturing task. In this respect, it would be desirable if an illuminated ceiling fan device were provided which did not employ electrical contacts having curved surface which are located on the outside wall of a cylindrical support.

Another problem associated with electrical contacts having curved surfaces located on the outside wall of a cylindrical support is that they wear down brushes that contact them in a complementary curved wear pattern. As a result the brushes get very sharp edges which are relatively structurally weak. Thus, the brushes are susceptible to premature wear and the need for replacement. In this respect, it would be desirable if an illuminated ceiling fan device were provided which does not wear down brushes in a curved pattern.

In addition, the following U.S. patents disclose some additional illumination devices associated with rotating bodies: U.S. Pat. Nos. 3,701,498; 4,342,073; and 4,356,535. More specifically, U.S. Pat. No. 3,701,498 discloses helicopter blades that are illuminated by fiber optics in the blades which receive light from a stationary light source. U.S. Pat. No. 4,342,073 discloses an illuminated ceiling fan which does not include illuminated blades. U.S. Pat. No. 4,356,535 discloses a ceiling light fixture which contains both a source of illumination and a fan in a common housing.

Still other features would be desirable in an illuminated blade, ceiling fan apparatus. For example, a decal, emblem, or other design is often accentuated by light that emanates from behind the decal, emblem, etc.; that is, the decal, emblem, etc. is associated with backlighting. In this respect, it would be desirable if an illuminated ceiling fan device were provided which included a decal, emblem, etc. on a fan blade which is internally illuminated and provides backlighting for the decal, emblem, etc.

Thus, while the foregoing body of prior art indicates it to be well known to use ceiling fans that have illuminated blades, the prior art described above does not teach or suggest an illuminated blade, ceiling fan apparatus which has the following combination of desirable features: (1) includes support for neon tubes which are more secure than mere edge support; (2) does not employ electrical contacts having curved surfaces which are located on the outside wall of a cylindrical support; (3) does not wear down brushes in a curved pattern; (4) does not change the contour of the fan blade at the edge of the fan blade; and (5) is internally illuminated and provides backlighting for a decal, emblem, or the like. The foregoing desired characteristics are provided by the unique illuminated blade, ceiling fan apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved illuminated blade, ceiling fan apparatus which includes a stationary housing assembly which houses a fan motor and is adapted to be supported by a ceiling. The apparatus includes a rotatable support assembly, driven by the fan motor, which support a plurality of fan blade assemblies, and the fan blade assemblies support respective sources of illumination. The apparatus includes a circular planar electrical contact assembly which includes a first circular planar conductor and a second circular planar conductor spaced from the first planar conductor such that the first planar conductor and the second planar conductor are not in electrical contact with each other. A brush contact assembly includes brushes for providing sliding electrical contact with the first planar conductor and the second planar conductor when there is relative rotation between the circular planar electrical contact assembly and the brush contact assembly. The respective sources of illumination supported by the fan blade assemblies are in circuit with the circular planar electrical contact assembly and the brush contact assembly, such that the sources of illumination are energized when the brush contact assembly is in electrical contact with the first circular planar conductor and the second circular planar conductor.

The first circular planar conductor and the second circular planar conductor each include a continuous circular conductive path. The circular planar electrical contact assembly rotates with the fan blade assemblies and is supported by the rotatable support assembly, and the brush contact assembly is stationary and is supported by the stationary housing assembly. The first circular planar conductor lies in a first plane, the second circular planar conductor lies in a second plane, and the first plane and the second plane are parallel planes. The first circular planar conductor is supported by a first planar support, and the second circular planar conductor is supported by a second planar support. The illumination source is a neon lamp assembly.

In an alternate embodiment of the invention, the circular planar electrical contact assembly may be stationary and may be supported by the stationary housing assembly; and the brush contact assembly may rotate with the fan blade assemblies and is supported by the rotatable support assembly.

The fan blade assemblies may include blade members which include hollow interiors. The blade members are made from transparent materials. The sources of illumination are housed within the hollow interiors of the transparent blade members. A partially opaque and partially transparent design is supported by a transparent blade member, such that, when a source of illumination is energized, the partially opaque and partially transparent design is provided with backlighting.

In yet another alternative embodiment of the invention, either the first circular planar conductor or the second circular planar conductor includes a discontinuous circular conductive path. The discontinuous conductive path provides intermittent illumination.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved illuminated blade, ceiling fan apparatus which has all of the advantages of the prior art and none of the disadvantages.

It is another object of the present invention to provide a new and improved illuminated blade, ceiling fan apparatus which may be easily and efficiently manufactured and marketed.

It is a further object of the present invention to provide a new and improved illuminated blade, ceiling fan apparatus which is of durable and reliable construction.

An even further object of the present invention is to provide a new and improved illuminated blade, ceiling fan apparatus which is susceptible of a low cost of manufacture with regard to both materials and labor, and which accordingly is then susceptible of low prices of sale to the consuming public, thereby making such illuminated blade, ceiling fan apparatus available to the buying public.

Still yet a further object of the present invention is to provide a new and improved illuminated blade, ceiling fan apparatus which includes support for neon tubes which are more secure than mere edge support.

Still another object of the present invention is to provide a new and improved illuminated blade, ceiling fan apparatus that does not employ electrical contacts having curved surfaces which are located on the outside wall of a cylindrical support.

Yet another object of the present invention is to provide a new and improved illuminated blade, ceiling fan apparatus which does not wear down brushes in a curved pattern.

Even another object of the present invention is to provide a new and improved illuminated blade, ceiling fan apparatus that does not change the contour of the fan blade at the edge of the fan blade.

Still a further object of the present invention is to provide a new and improved illuminated blade, ceiling fan apparatus which is internally illuminated and provides backlighting for a decal, emblem, or the like.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figures 1, 2:
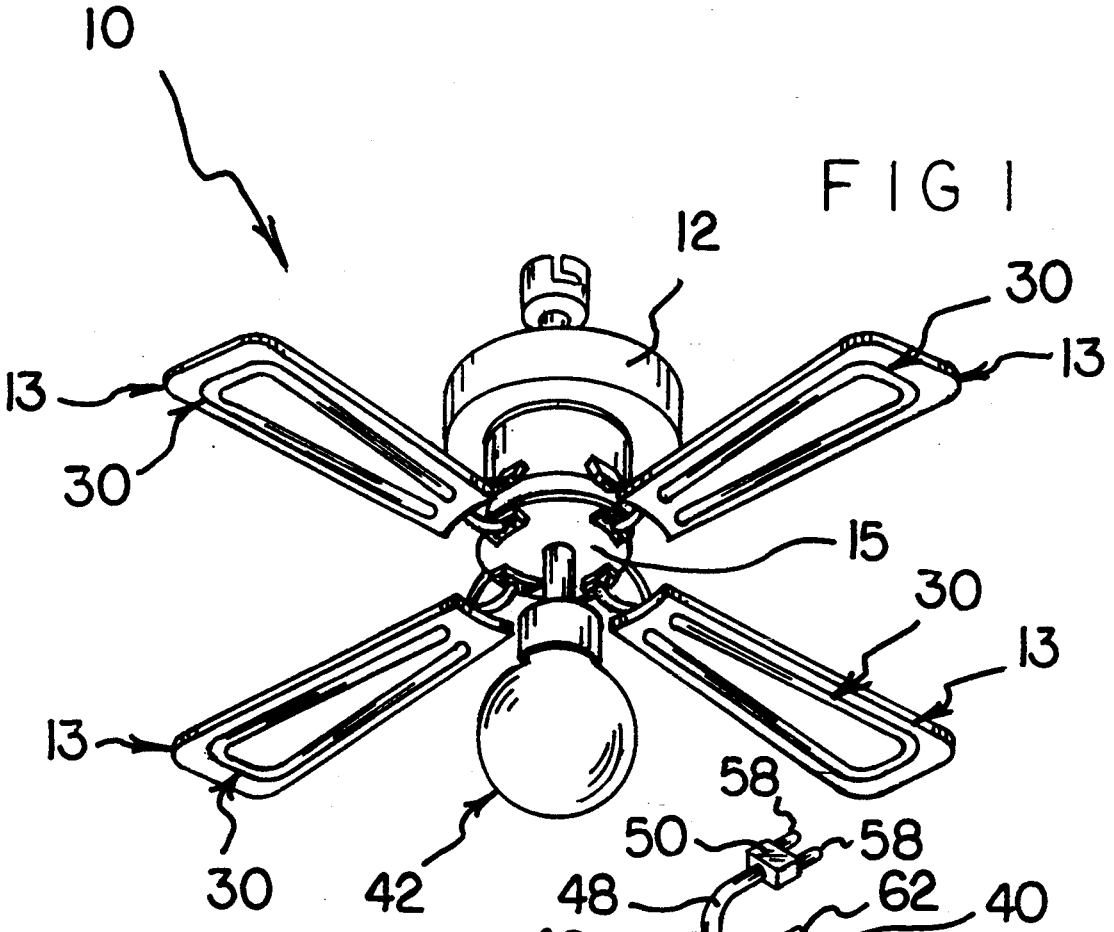
FIG. 1 is a perspective view showing a first preferred embodiment of the illuminated blade, ceiling fan apparatus of the invention.
FIG. 2 is a partially exploded, enlarged perspective view of one illuminated blade in the apparatus shown in FIG. 1.
Figure 3:
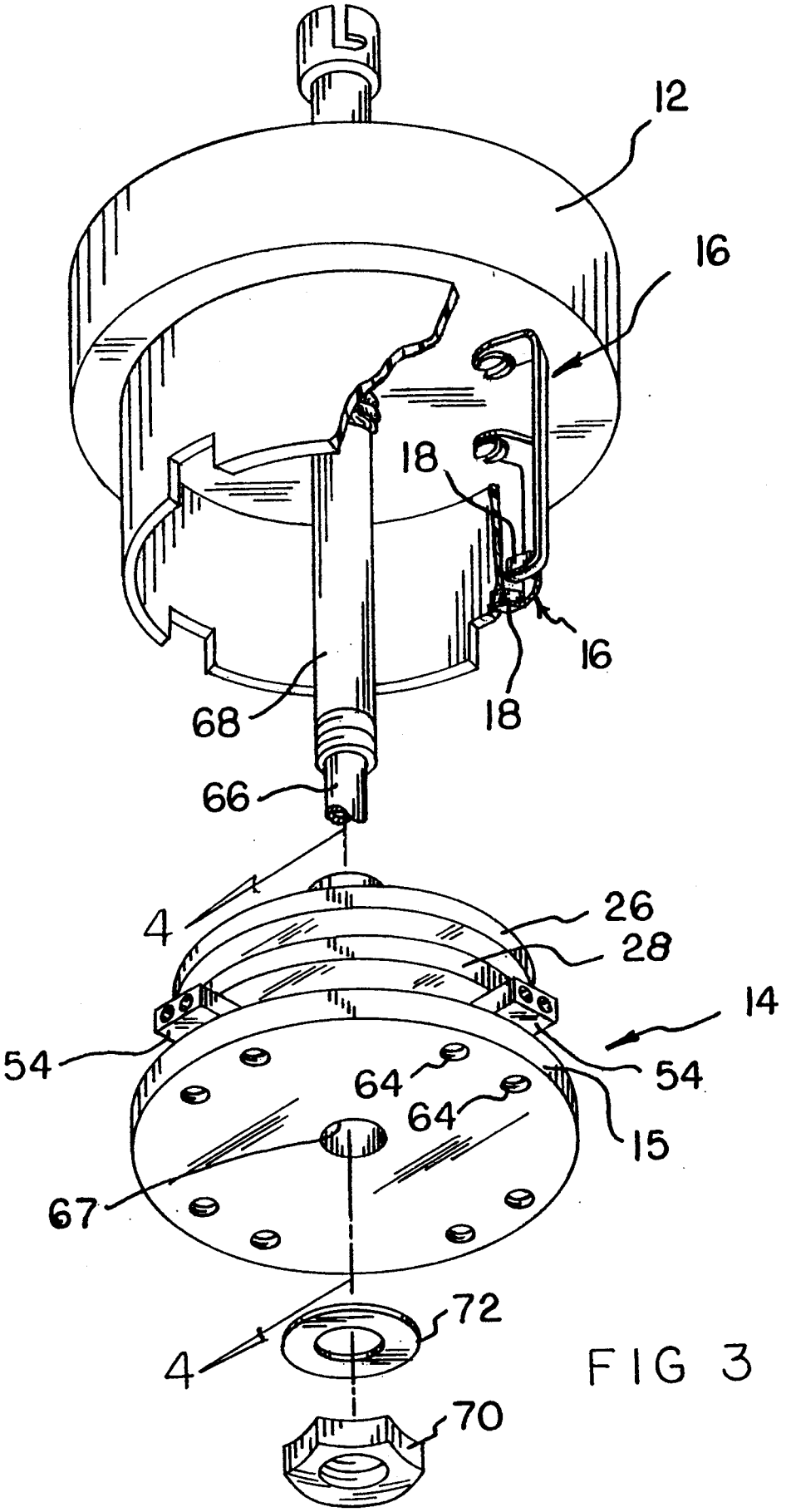
FIG. 3 is a partially exploded, enlarged perspective view of the electrical contact assembly and housing used with the embodiment of the invention shown in FIG. 1.
Figure 4:
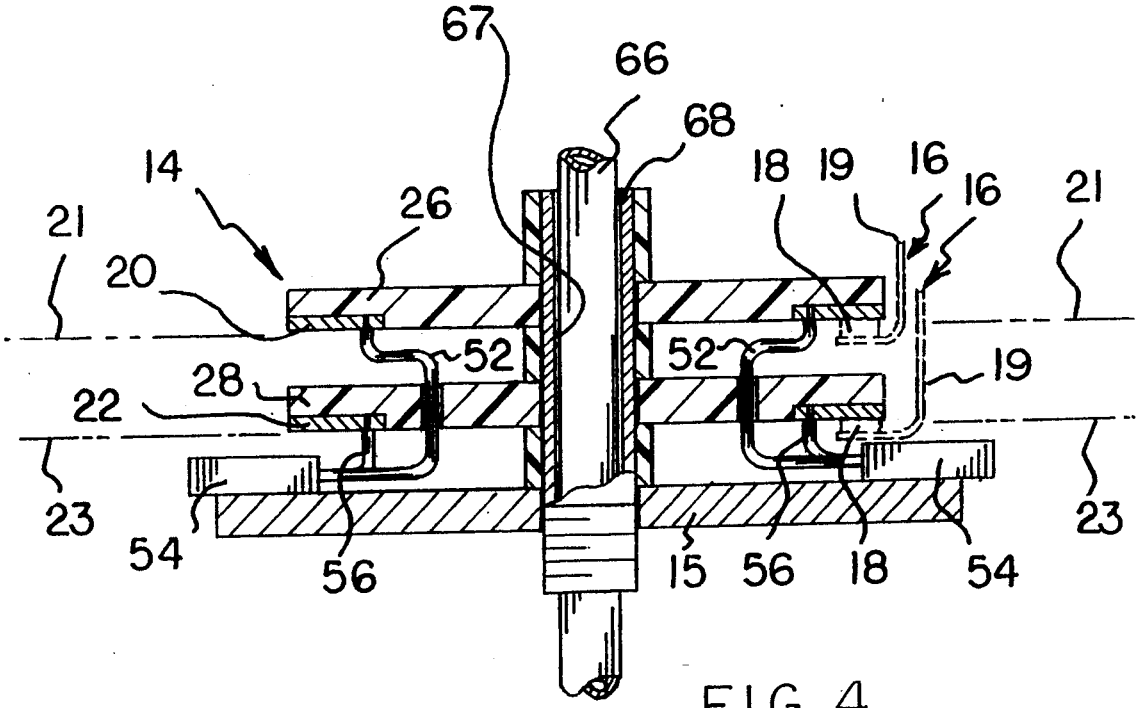
FIG. 4 is an enlarged cross-sectional view of the electrical contact assembly shown in the embodiment in FIG. 3 taken along line 4—4 of FIG. 3.
Figure 5:
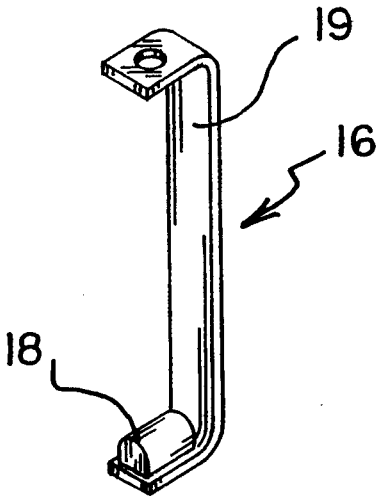
FIG. 5 is an enlarged perspective view of a replaceable brush used with the embodiment of the invention shown in FIGS. 3 and 4.

With reference to the drawings, a new and improved illuminated blade, ceiling fan apparatus embodying the principles and concepts of the present invention will be described.

Turning initially to FIGS. 1–5, there is shown a first exemplary embodiment of the illuminated blade, ceiling fan apparatus of the invention generally designated by reference numeral 10. In its preferred form, illuminated blade, ceiling fan apparatus 10 includes a stationary housing assembly 12 which houses a fan motor and is adapted to be supported by a ceiling. The apparatus 10 includes a rotatable support assembly 15, driven by the fan motor, which support a plurality of fan blade assemblies 13, and the fan blade assemblies 13 support respective sources 30 of illumination. The apparatus 10 includes a circular planar electrical contact assembly 14 which includes a first circular planar conductor 20 and a second circular planar conductor 22 spaced from the first planar conductor 20 such that the first planar conductor 20 and the second planar conductor 22 are not in electrical contact with each other. A brush contact assembly 16 includes brushes 18 for providing sliding electrical contact with the first planar conductor 20 and the second planar conductor 22 when there is relative rotation between the circular planar electrical contact assembly 14 and the brush contact assembly 16. The respective sources 30 of illumination supported by the fan blade assemblies 13 are in circuit with the circular planar electrical contact assembly 14 and the brush contact assembly 16, such that the sources 30 of illumination are energized when the brush contact assembly 16 is in electrical contact with the first circular planar conductor 20 and the second circular planar conductor 22.

The first circular planar conductor 20 and the second circular planar conductor 22 includes a continuous circular conductive path. The circular planar electrical contact assembly 14 rotates with the fan blade assemblies 13 and is supported by the rotatable support assembly 15, and the brush contact assembly 16 is stationary and is supported by the stationary housing assembly 12. The first circular planar conductor 20 lies in a first plane 21, the second circular planar conductor 22 lies in a second plane 23, and the first plane 21 and the second plane 23 are parallel planes. The first circular planar conductor 20 is supported by a first planar support 26, and the second circular planar conductor 22 is supported by a second planar support 28. The illumination source is a neon lamp assembly 30.

In use, the stationary housing assembly 12 is connected to a ceiling. The stationary housing assembly 12 houses a fan motor (not shown) and includes a rotatable support assembly 15, driven by the fan motor, for supporting a plurality of fan blade assemblies 13. Each fan blade assembly 13 includes a blade member 32 and a support assembly 34 for connecting the blade member 32 to the rotatable support assembly 15. The support assembly 34 includes a first connector 36 connected to the blade member 32. A strut member 38 is connected to the first connector 36, and a second connector 40 is connected to the strut member 38. The second connector 40 is connected to the rotatable support assembly 15.

The neon lamp assembly 30 includes a glass tube 44, a sealed connector 46 supporting the glass tube 44, an electrical cable 48 connected to the sealed connector 46, and an electrical plug 50 connected to the electrical cable 48. The first circular planar conductor 20 of the circular planar electrical contact assembly 14 is connected to a lead 52 which is connected to a jack 54. The second circular planar conductor 22 is connected to a lead 56 which is also is connected to the jack 54. Each jack 54 has two receptacles and connectors for receiving complementary prongs 58 on the electrical plug 50.

The brush contact assembly 16 includes brushes 18 for providing sliding electrical contact with the first planar conductor 20 and the second planar conductor 22 when there is relative rotation between the circular planar electrical contact assembly 14 and the brush contact assembly 16. The brushes 18 are supported by brush supports 19. More specifically, one of the brushes 18 is connected to one AC wire, and the other brush 18 is connected to a second AC wire. The brushes 18 remain stationary as the fan blade assemblies 13 and the circular planar electrical contact assembly 14 rotate when driven by the fan motor. The brushes 18 convey the AC power from the respective AC wires through the respective first circular planar conductor 20 and second circular planar conductor 22 to the neon lamp assembly 30 for energizing and lighting the neon lamp assembly 30. Each fan blade assembly 13 has its associated neon lamp assembly 30, lead 52, lead 56, and jack 54.

Each blade member 32 has apertures 60 through which portion of the glass tube 44 of the neon lamp assembly 30 are passed. The respective second connectors 40 of the respective support assemblies 34 have apertures 62. In addition, apertures 64 are provided in the rotatable support assembly 15. The apertures 62 are placed in registration with the apertures 64 in the rotatable support assembly 15, and fasteners, such as bolts (not shown) are passed through the registered apertures. Nuts (not shown) are fastened to the bolts to secure the respective fan blade assemblies 13 to the rotatable support assembly 15.

The first planar support 26 and the second planar support 28 of the circular planar electrical contact assembly 14 are in the form of circular discs. A drive shaft 66 comes out of the fan motor and passes through respective central apertures 67 in the respective first circular planar conductor 20, the second circular planar conductor 22, and the rotatable support assembly 15. A sleeve 68 is placed on the drive shaft 66, is threaded and receives a complementarily threaded nut 70 for retaining the circular planar electrical contact assembly 14, the rotatable support assembly 15, and the fan blade assemblies 13 on the drive shaft 66. A washer 72 is placed between the nut 70 and the rotatable support assembly 15.

A stationary lamp assembly 42 is also supported by the stationary housing assembly 12.

In an alternative embodiment in accordance with the invention, the circular planar electrical contact assembly 14 is stationary and is supported by the stationary housing assembly 12; and the brush contact assembly 16 rotates with the fan blade assemblies 13 and is supported by the rotatable support assembly 15. In such an alternative embodiment, the first circular planar conductor 20 and the second circular planar conductor 22 are connected to one AC power wire and another AC power wire, respectively. Also, in such an alternate embodiment, a pair of brush contact assemblies 16 is associated with each fan blade assembly 13 and each neon lamp assembly 30.

Figure 6:
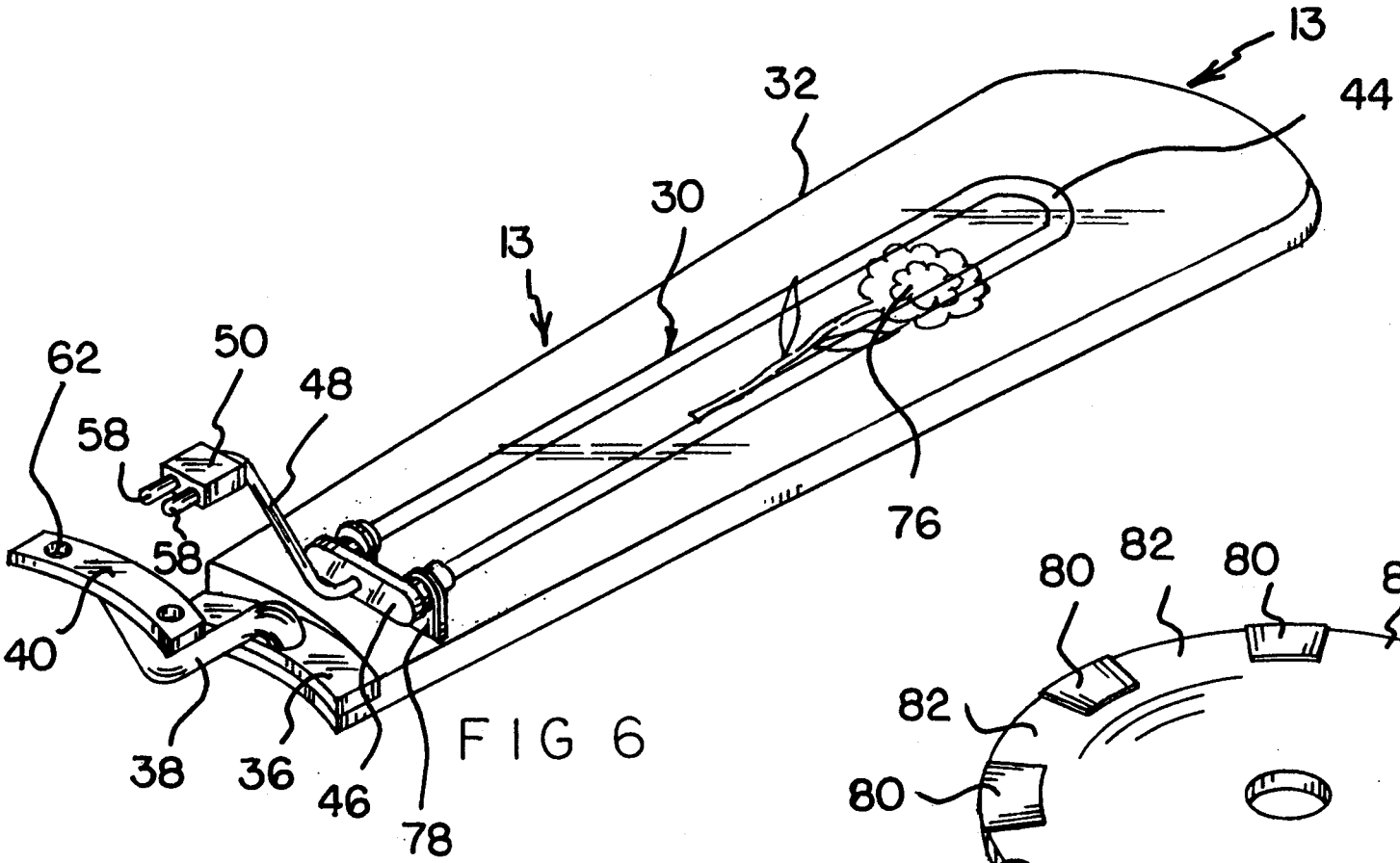
FIG. 6 is a perspective view of a second embodiment of a fan blade assembly for the illuminated blade, ceiling fan apparatus of the invention wherein a neon lamp is housed inside a transparent fan blade.

Turning to FIG. 6, a fan blade assembly 13 and a neon lamp assembly 30 of a second embodiment of the invention are shown. Reference numerals are shown that correspond to like reference numerals that designate like elements shown in the other figures. In addition, the fan blade assemblies 13 include blade members 32 which include hollow interiors. The blade members 32 are made from transparent materials, e. g. Plexiglass TM. The sources 30 of illumination are housed within the hollow interiors of the transparent blade members 32. Mounting brackets 78 are used to secure the sources 30 of illumination inside the hollow interiors of the blade member 32.

A partially opaque and partially transparent design 76 is supported by a transparent blade member 32, such that, when a source 30 of illumination is energized, the partially opaque and partially transparent design 76 is provided with backlighting. The partially opaque and partially transparent design 76 can be any desired design. For example, an eagle can be associated with an American. A four-leaf clover can be associated with an Irishman. Moreover, the transparent blade members 32 can be a variety of colors of the rainbow.

Figure 7:
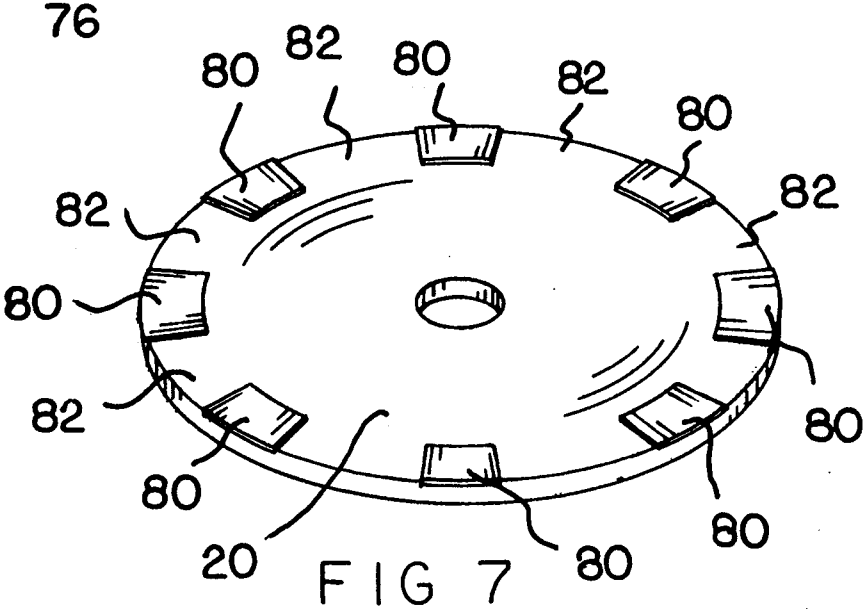
FIG. 7 is a perspective view of a contact plate used with a third embodiment of the invention wherein the lamp that is employed undergoes intermittent energizing and deenergizing.

Turning to FIG. 7, a key component of a third embodiment of the invention is shown. Reference numerals are shown that correspond to like reference numerals that designate like elements shown in the other figures. In addition, either the first circular planar conductor 20 or the second circular planar conductor 22 (first circular planar conductor 20 shown in FIG. 7) includes a discontinuous circular conductive path. More specifically, the discontinuous conductive path includes a plurality of conductive segments 80 alternating between a plurality of non-conductive segments 82 arrayed in a circular band near the perimeter of the first circular planar conductor 20. The alternating conductive and non-conductive segments cause the sources 30 of illumination to be alternatingly energized and deenergized as the fan blade assemblies 13 rotate around the stationary housing assembly 12.

The components of the illuminated blade, ceiling fan apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved illuminated blade, ceiling fan apparatus that is low in cost, relatively simple in design and operation, and which may advantageously be used to support neon tubes on fan blades in a way that is more secure than mere edge support. With the invention, an illuminated blade, ceiling fan apparatus is provided which does not employ electrical contacts having curved surfaces which are located on the outside wall of a cylindrical support. With the invention, an illuminated blade, ceiling fan apparatus is provided which does not wear down brushes in a curved pattern. With the invention, an illuminated blade, ceiling fan apparatus is provided which does not change the contour of the fan blade at the edge of the fan blade. With the invention, an illuminated blade, ceiling fan apparatus is provided which is internally illuminated and provides backlighting for a decal, emblem, or the like.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by LETTERS PATENT of the United States is as follows:

1. An illuminated blade, ceiling fan apparatus which includes a stationary housing assembly which houses a fan motor and which is adapted to be supported by a ceiling and which includes a rotatable support assembly, driven by the fan motor, for supporting a plurality of fan blade assemblies which support respective sources of illumination, said apparatus comprising:

a circular planar electrical contact assembly which includes a first circular planar conductor and a second circular planar conductor spaced from said first planar conductor such that said first planar conductor and said second planar conductor are not in electrical contact with each other, and a brush contact assembly which includes brushes for providing sliding electrical contact with said first planar conductor and said second planar conductor when there is relative rotation between said circular planar electrical contact assembly and said brush contact assembly, wherein the respective sources of illumination supported by the fan blade assemblies are in circuit with said circular planar electrical contact assembly and said brush contact assembly, such that said sources of illumination are energized when said brush contact assembly is in electrical contact with said first circular planar conductor and said second circular planar conductor, wherein:

said circular planar electrical contact assembly rotates with the fan blade assemblies and is supported by the rotatable support assembly, and said brush contact assembly is stationary and is supported by the stationary housing assembly.

2. The apparatus described in claim 1 wherein said first circular planar conductor and said second circular planar conductor include a continuous circular conductive path.

3. The apparatus described in claim 1 wherein:

said first circular planar conductor lies in a first plane, said second circular planar conductor lies in a second plane, and said first plane and said second plane are parallel planes.

4. The apparatus described in claim 3 wherein:

said first circular planar conductor is supported by a first planar support, and said second circular planar conductor is supported by a second planar support.

5. The apparatus described in claim 1 wherein said illumination source is a neon lamp assembly.

6. The apparatus described in claim 1 wherein:

said fan blade assemblies include blade members which include hollow interiors, said blade members are made from a transparent material, and the sources of illumination are housed within said hollow interiors of said transparent blade members.

7. The apparatus described in claim 6, further including:

a partially opaque and partially transparent design supported by at least one of said transparent blade members, such that, when a source of illumination is energized, said partially opaque and partially transparent design is provided with backlighting.

8. The apparatus described in claim 1 wherein:

either of said first circular planar conductor or said second circular planar conductor includes a discontinuous circular conductive path.

* * * * *